US010923833B2

(12) United States Patent
Solano Siller et al.

(10) Patent No.: US 10,923,833 B2
(45) Date of Patent: Feb. 16, 2021

(54) REINFORCED FEMALE WIRE TERMINAL

(71) Applicant: Aptiv Technologies Limited, St. Michael (BB)

(72) Inventors: Luis Eduardo Solano Siller, Saltillo (MX); Victor M. Retana, Saltillo (MX); Luis Daniel Berino Avalos, Saltillo (MX); Robert B. Snader, Jr., Solon, OH (US)

(73) Assignee: APTIV TECHNOLOGIES LIMITED

( * ) Notice: Subject to any disclaimer, the term of this patent is extended or adjusted under 35 U.S.C. 154(b) by 32 days.

(21) Appl. No.: 16/441,812

(22) Filed: Jun. 14, 2019

(65) Prior Publication Data

US 2020/0395687 A1 Dec. 17, 2020

(51) Int. Cl.
*H01R 13/514* (2006.01)
*H01R 4/18* (2006.01)

(52) U.S. Cl.
CPC ..... *H01R 4/18* (2013.01)

(58) Field of Classification Search
CPC ..... H01R 13/4362
USPC ..... 439/752, 595
See application file for complete search history.

(56) References Cited

U.S. PATENT DOCUMENTS 6,354,873 B1 3/2002 Morello et al.
7,252,562 B1 * 8/2007 Chen ..... H01R 13/187 439/852
7,278,890 B1 10/2007 Smutny et al.
7,347,747 B2 * 3/2008 Shimizu ..... H01R 13/11 439/842
8,262,410 B2 9/2012 Campbell et al.
9,153,899 B2 10/2015 Morello et al.
9,407,026 B2 8/2016 Campbell et al.
9,917,381 B1 3/2018 Campbell et al.

FOREIGN PATENT DOCUMENTS

CN 204289809 U 4/2015
CN 105811144 A 7/2016
EP 3171459 A1 5/2017

OTHER PUBLICATIONS

Taxi Term F OCS 1.2 Drawing No. 13543112, Delphi Corporation, published May 1, 2014.
Unsealed Female Connector Sub-Assembly Drawing No. 7289-7293-30:R, Yazaki Corporation, published Oct. 30, 2018.

* cited by examiner

*Primary Examiner* — Phuong K Dinh
(74) *Attorney, Agent, or Firm* — Billion & Armitage; Robert Myers

(57) ABSTRACT

A female wire terminal includes a box extending longitudinally from a crimp end to an open forward end that is configured to receive a male wire terminal. The box is provided by upper and lower walls joined by a first lateral wall. A second lateral wall is joined to the lower wall opposite the first lateral wall. The upper wall provides a protrusion that is configured to cooperate with an electrical connector. The upper wall overlaps and abuts at a rearward end of a longitudinal edge of the second lateral wall opposite the first lateral wall. The rearward end is opposite the open end.

19 Claims, 7 Drawing Sheets

REINFORCED FEMALE WIRE TERMINAL

TECHNICAL FIELD OF THE INVENTION

This disclosure relates to a female wire terminal for use with a wire connector having a secondary lock.

BACKGROUND OF THE INVENTION

A typical electrical connector includes numerous electrical terminals that are inserted into the connector and securely retained during an assembly procedure. One type of electrical connector includes multiple female electrical terminals having a longitudinally extending box-like structure with various features that cooperate with a primary and a secondary lock. These locks retain the female electrical terminals within the electrical connector during assembly and subsequent use.

If the female electrical terminal is not fully seated within its electrical connector when a secondary lock is pushed inward to retain all of the female electrical terminals within the electrical connector, then the secondary lock may crush the rearward end of the box-like structure allowing the secondary lock to be closed, which gives a false indication that all of the female electrical terminals within the connector are fully seated and properly installed even when they are not. An improperly installed female electrical terminal may lead to electrical malfunctions in the electrical system.

BRIEF SUMMARY OF THE INVENTION

In one embodiment of the invention, a female electrical terminal is provided. The female electrical terminal includes a box portion extending longitudinally from an attachment portion to an open forward end that is configured to receive a male electrical terminal. The box portion is provided by an upper wall and a lower wall joined by a first lateral wall and a second lateral wall joined to the lower wall opposite the first lateral wall. A portion of the upper wall overlaps and abuts a longitudinal edge of the second lateral wall opposite at a rearward end of the box portion opposite the open forward end.

In an example embodiment having one or more features of the female electrical terminal of the previous paragraph, the upper wall defines a cutout and the second lateral wall includes a tab received in the cutout.

In an example embodiment having one or more features of the female electrical terminal of the previous paragraph, the second lateral wall includes a lateral indentation longitudinally aligned with the tab.

In an example embodiment having one or more features of the female electrical terminal of the previous paragraph, the upper wall includes an upper indentation longitudinally aligned with the cutout.

In an example embodiment having one or more features of the female electrical terminal of the previous paragraph, the first and second lateral walls respectively include first and second notches that respectively provide first and second ledges. The upper wall has a folded end portion overlapping the first and second ledges.

In an example embodiment having one or more features of the female electrical terminal of the previous paragraph, the upper wall defines a cutout. The second lateral wall has a tab received in the cutout. The first and second lateral walls respectively include first and second notches that respectively provide first and second ledges. The upper wall has a folded end portion overlapping the first and second ledges.

In an example embodiment having one or more features of the female electrical terminal of the previous paragraph, the box portion includes a lateral indentation arranged in the second lateral wall and longitudinally aligned with the tab or an upper indentation arranged in the upper wall and longitudinally aligned with the cutout.

In an example embodiment having one or more features of the female electrical terminal of the previous paragraph, the upper wall has a first contact tab extending inward into the open forward end of the box portion and the lower wall has a second contact tab extending inward into the open forward end of the box portion.

In an example embodiment having one or more features of the female electrical terminal of the previous paragraph, at least one of the first and second contact tabs includes a slot configured to receive a nub on the male electrical terminal.

In an example embodiment having one or more features of the female electrical terminal of the previous paragraph, the upper wall provides a protrusion provided by a raised portion on the upper wall and a bent member on the second lateral wall that is arranged about a corner of the raised portion and the protrusion is configured to cooperate with an electrical connector.

In one embodiment of the invention, an electrical connector is provided. The electrical connector includes a connector body having a longitudinal opening with a width and a height. The longitudinal opening including a groove. A primary lock is aligned with the groove. The electrical connector also includes a secondary lock slideably supported by the connector body. The secondary lock is movable between an open position, a blocked position, and a closed position. The blocked position is arranged between the open position and the closed position. The electrical connector further includes a female electrical terminal having a box portion extending longitudinally from an attachment portion to an open forward end that is configured to receive a male electrical terminal. The box portion is provided by an upper wall and a lower wall joined by a first lateral wall and a second lateral wall joined to the lower wall opposite the first lateral wall. A portion of the upper wall overlaps and abuts a longitudinal edge of the second lateral wall opposite at a rearward end of the box portion opposite the open forward end.

In an example embodiment having one or more features of the electrical connector of the previous paragraph, an abutment of the secondary lock with the upper wall forward of the rearward end inhibits movement of the secondary lock from the blocked position to the closed position when the female electrical terminal is in an unseated position within the electrical connector.

In an example embodiment having one or more features of the electrical connector of the previous paragraph, the upper wall defines a cutout and the second lateral wall has a tab received in the cutout.

In an example embodiment having one or more features of the electrical connector of the previous paragraph, the first and second lateral walls respectively include first and second notches that respectively provide first and second ledges. The upper wall has a folded end portion overlapping the first and second ledges.

In an example embodiment having one or more features of the electrical connector of the previous paragraph, the box portion includes a lateral indentation arranged in the second lateral wall and longitudinally aligned with the tab or an upper indentation arranged in the upper wall and longitudinally aligned with the cutout.

In an example embodiment having one or more features of the electrical connector of the previous paragraph, the first and second lateral walls respectively include first and second notches that respectively provide first and second ledges. The upper wall has a folded end portion overlapping the first and second ledges. The folded end portion is spaced apart from the first and second ledges when the secondary lock does not abut the upper wall.

In an example embodiment having one or more features of the electrical connector of the previous paragraph, the folded end portion engages the first and second ledges when the secondary lock abuts the upper wall when in the blocked position.

In an example embodiment having one or more features of the electrical connector of the previous paragraph, the upper wall provides a protrusion formed by a raised portion on the upper wall and a bent member on the second lateral wall that is arranged about a corner of the raised portion. The protrusion is seated against the primary lock when the female electrical terminal is in a fully seated position.

In an example embodiment having one or more features of the electrical connector of the previous paragraph, the secondary lock is positioned between the rearward end of the box portion and the attachment portion when in the closed position.

In an example embodiment having one or more features of the electrical connector of the previous paragraph, the upper wall defines a cutout the second lateral wall has a tab received in the cutout.

In one embodiment of the invention, a method of assembling an electrical connector is provided. The method includes the step of inserting a female electrical terminal into an longitudinal opening of the electrical connector. The female electrical terminal has a box portion extending longitudinally from an attachment portion to an open forward end that is configured to receive a male electrical terminal. The box portion is provided by an upper wall and a lower wall joined by a first lateral wall and a second lateral wall joined to the lower wall opposite the first lateral wall. The upper wall provides a protrusion configured to cooperate with the electrical connector. A portion of the upper wall overlaps and abuts a longitudinal edge of the second lateral wall opposite at a rearward end of the box portion opposite the open forward end. The method also includes the steps of deflecting a primary lock disposed in the longitudinal opening with the protrusion on the female electrical terminal and sliding a secondary lock from an open position toward a locked position to retain the female electrical terminal in the electrical connector.

In an example embodiment having one or more features of the method of the previous paragraph, an abutment of the secondary lock with the upper wall forward of the rearward end inhibits movement of the secondary lock from a blocked position, arranged between the open position and the locked position, to the locked position when the female electrical terminal is in an unseated position within the electrical connector.

In an example embodiment having one or more features of the method of the previous paragraph, the upper wall includes a notch, the second lateral wall has a tab received in the notch, the first and second lateral walls respectively include first and second notches that respectively provide first and second ledges, the upper wall has a folded end portion overlapping the first and second ledges, and the box portion includes a lateral indentation arranged in the second lateral wall and longitudinally aligned with the tab or an upper indentation arranged in the upper wall and longitudinally aligned with the notch.

BRIEF DESCRIPTION OF THE SEVERAL VIEWS OF THE DRAWING

The disclosure can be further understood by reference to the following detailed description when considered in connection with the accompanying drawings wherein.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible. Like reference numbers and designations in the various drawings indicate like elements.

DETAILED DESCRIPTION OF THE INVENTION

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

Figure 1A:
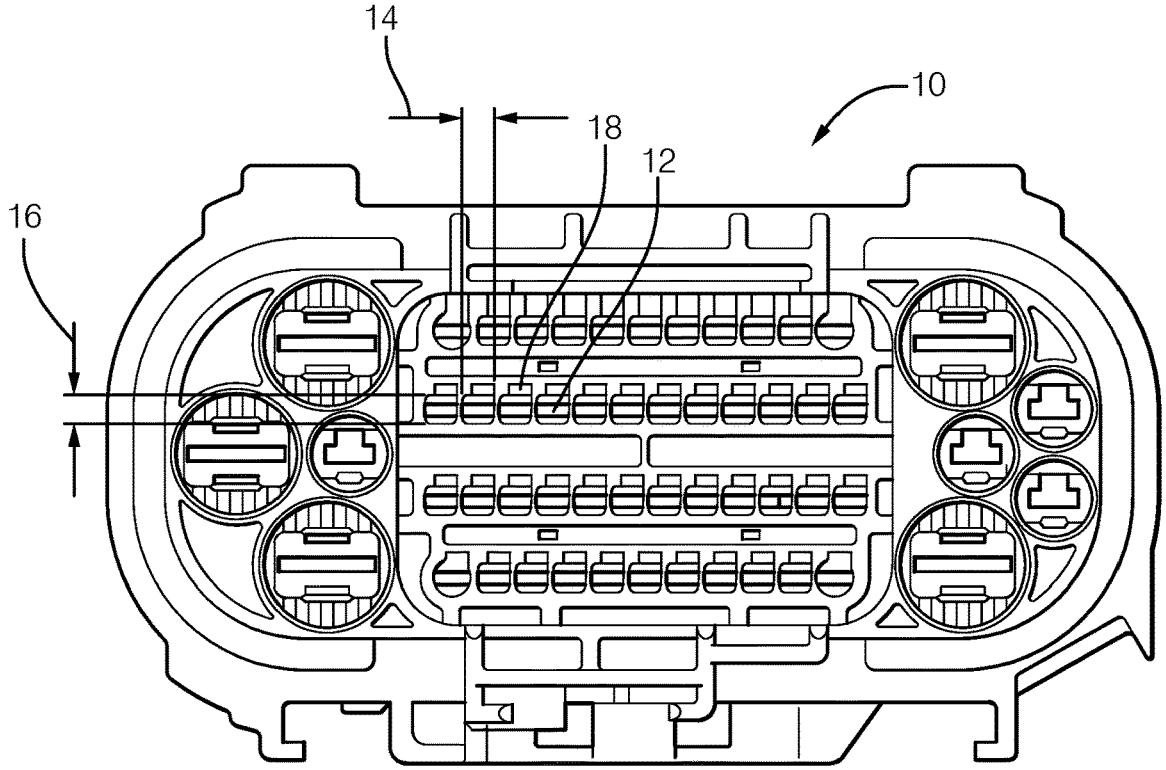
FIGS. 1A and 1B are front views of an example electrical connector without any electrical terminals and respectively illustrating a secondary lock in open and closed positions.
Figure 1B:
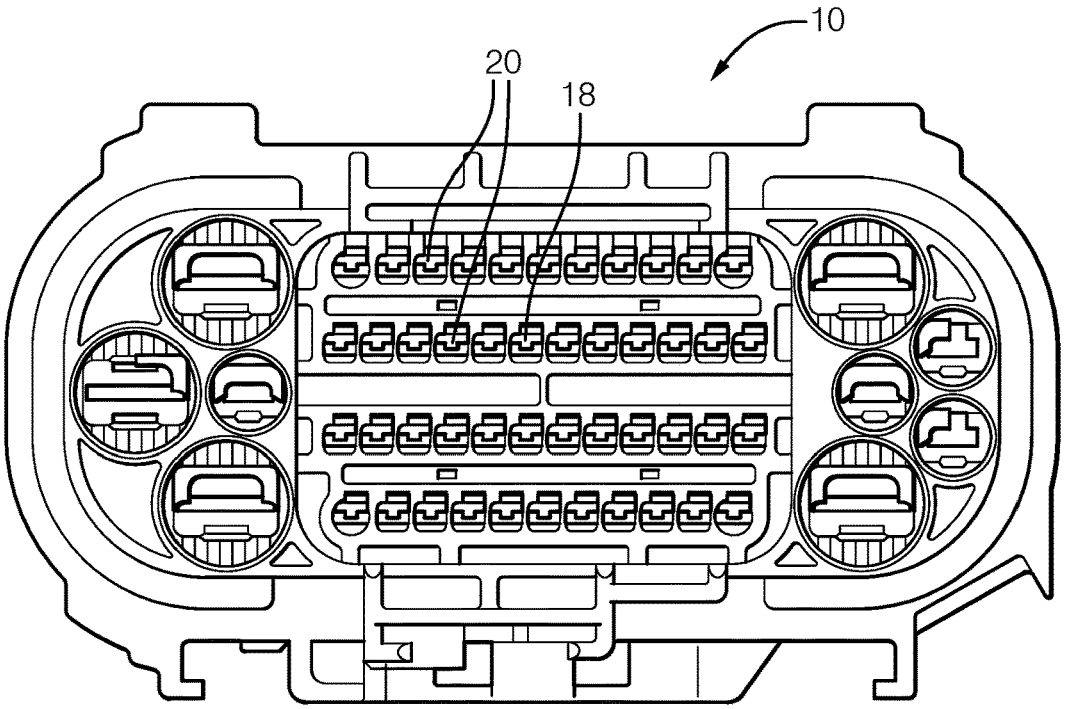

An example electrical connector 10 is illustrated in FIGS. 1A-1B. The electrical connector 10 is designed to securely support a number of electrical terminals such that the electrical terminals are not pushed out from the housing when engaging the complementary electrical terminals in another electrical connector. Of course, the electrical connector 10 may be configured with a great variety of shapes, numbers and combinations of electrical terminals.

The electrical connector 10 includes an opening 12 having a width 14 and a height 16. The width 14 of the opening 12 includes a groove 18 that is configured to receive a complementary shaped feature in an electrical terminal to ensure a desired orientation of the electrical terminal within the electrical connector 10 during assembly.

A secondary lock 20, typically of a different color than the electrical connector body, is slideably received on the electrical connector 10. A secondary lock 20 is arranged in an open position to enable the electrical terminals to be inserted into electrical connector 10. Once the electrical terminals are fully seated, the secondary lock 20 is moved from the open position (FIG. 1A) to a closed position (FIG. 1B) to further secure the retained electrical terminals within the body. The secondary lock 20 obstructs a portion of the opening 12 in the closed position. When closed the secondary lock 20 serves a visual indicator to the assembler that all electrical terminals are properly seated within the electrical connector 10.

Figure 2A:
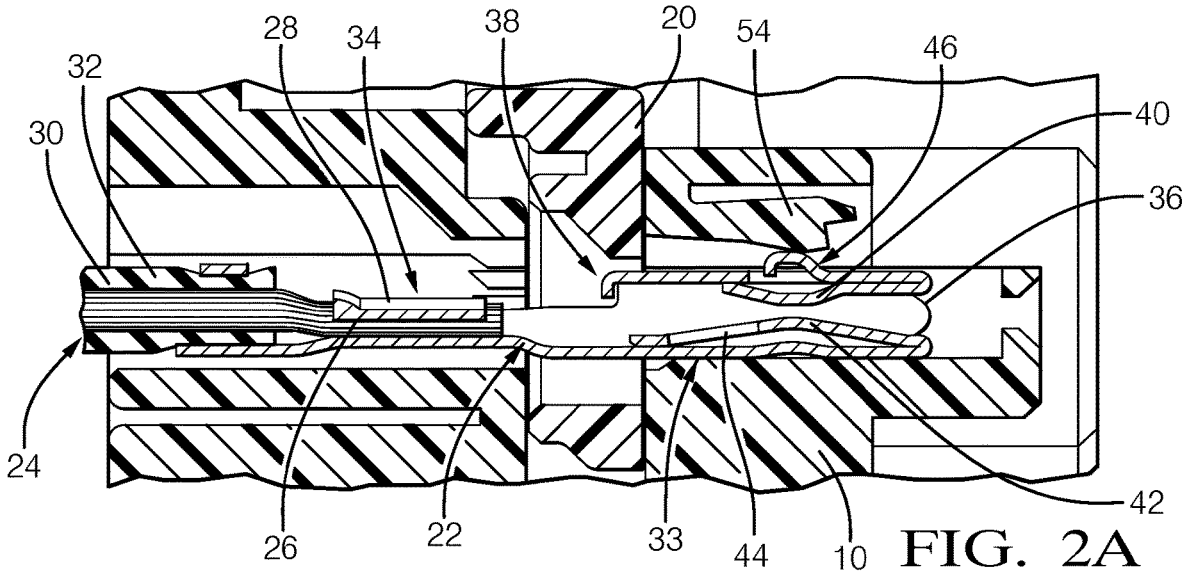
FIGS. 2A-2C are cross-sectional views respectively illustrating an example female electrical terminal in an unseated position, the female electrical terminal in a fully seated position with a secondary lock in an open position, and the female electrical terminal in a fully seated position with the secondary lock in a closed position.
Figure 2B:
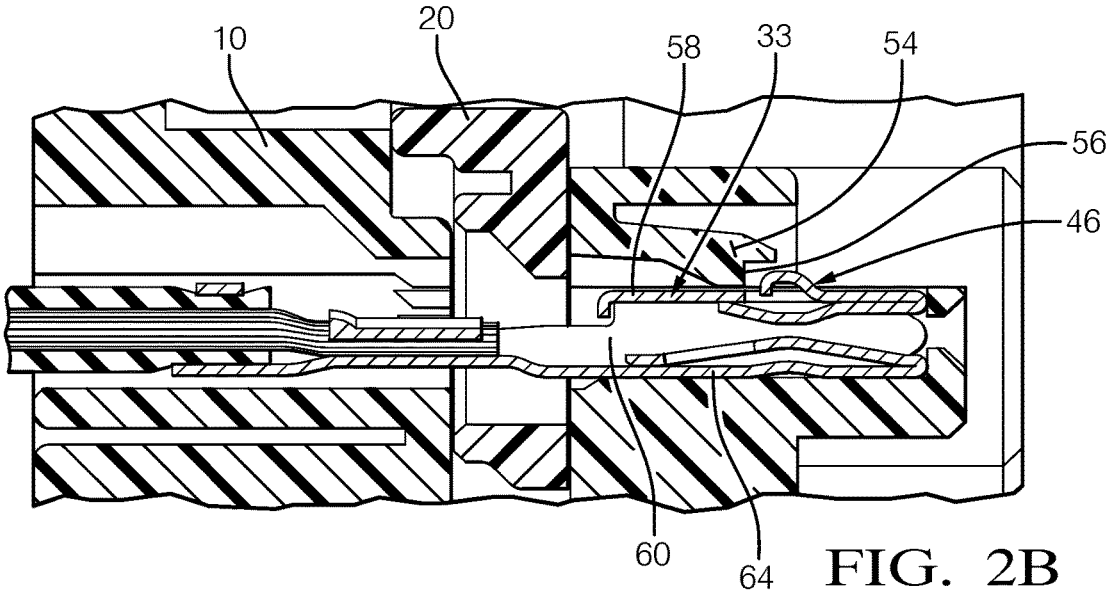
Figure 2C:
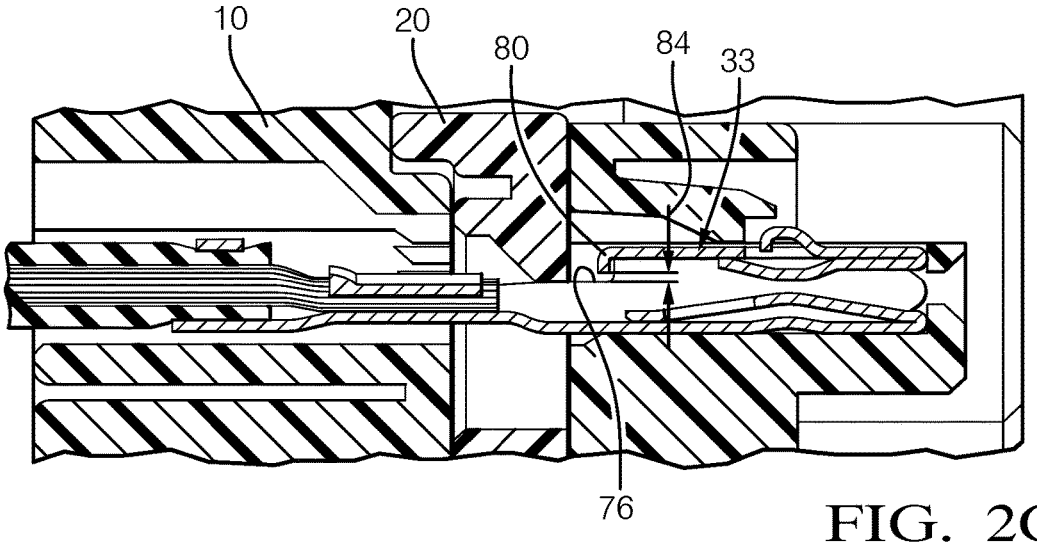

A cross-sectional view through the electrical connector 10 and one of the female electrical terminals 22 during various states of assembly is illustrated in FIGS. 2A-2C. As shown in the figures, an attachment portion of the female electrical terminal 22 secures a wire element 26 of a wire using wire crimp wings 28. Insulation 30 arranged around the wire element 26 is secured by insulation crimp wings 32. The wire crimp wings 28 and the insulation crimp wings 32 are provided on a crimp end 34 of the female electrical terminal 22, as is known.

A longitudinally extending box portion 33 extends from a rearward end 38 near the crimp end 34 to an open end 36 that is configured to receive a male electrical terminal (not shown, but well known). In the example, the box portion 33 has a generally square, hollow cross-section. The open end 36 includes first and second contact tabs 40, 42 that provide a narrow aperture that firmly engages the male electrical terminal. The second contact tab 42 also may include a slot 44 that is configured to receive a nub on the male electrical terminal.

A protrusion 46, which is received in the groove 18 during assembly, is provided on the box portion 33 and cooperates with a primary lock 54 during insertion of the female electrical terminal 22. The protrusion 46 biases the primary lock 54 upward (FIG. 2A) until the female electrical terminal 22 is fully seated, at which point the primary lock 54 deflects downward to a relaxed state, as illustrated in FIGS. 2B and 2C. A shoulder 56 of the primary lock 54 inhibits the protrusion 46 from sliding past the primary lock 54 if the wire 24 is pulled rearward.

Referring to FIGS. 2A-3B, the box portion 33 includes a first lateral wall 60 joined to an upper wall 58 and lower wall 64. A second lateral wall 62 is joined to the lower wall 64 opposite the first lateral wall 60. The protrusion 46 is provided by a raised portion 48 in the upper wall 58. A bent member 52 provided by the second lateral wall 62 wraps about a corner 50 of the raised portion 48, best shown in FIG. 3A.

Figure 4:
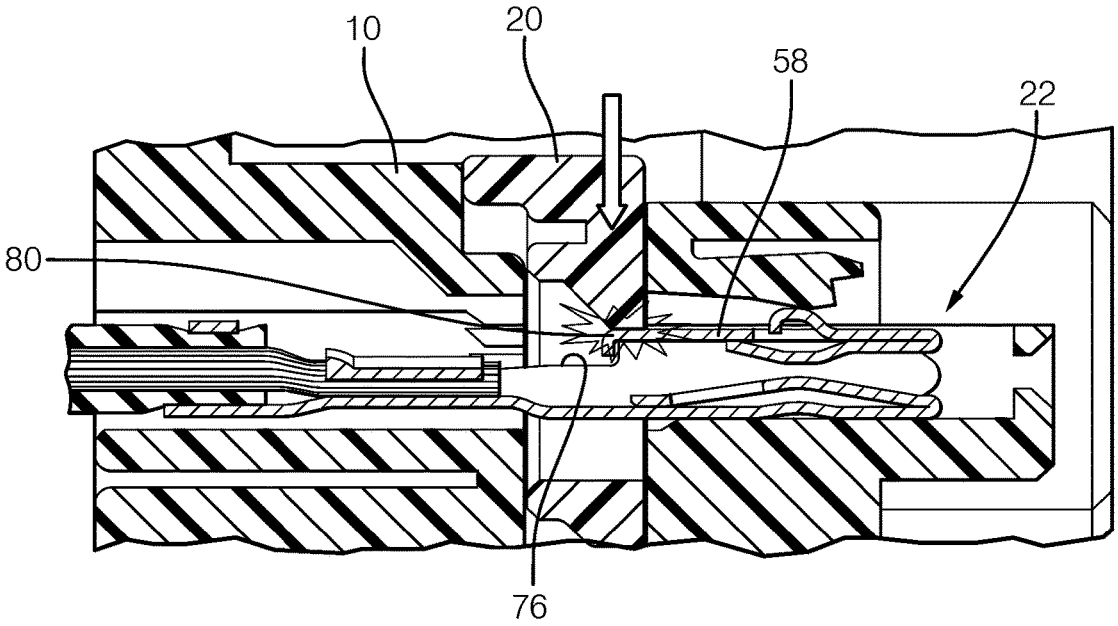
FIG. 4 is a cross-sectional view of the electrical connector with the secondary lock in a blocked position when the female electrical terminal is not fully seated.

The second lateral wall 62 includes a rectangular tab 68 that is received in a rectangular cutout 70 in an outer edge of the upper wall 58. The tab 68 and cutout 70 inhibit relative longitudinal movement of the upper wall 58 and second lateral wall 62 relative to one another during deflection. The second lateral wall 62 also includes a longitudinal edge 66 such that the upper wall 58 overlaps and abuts the longitudinal edge 66 at the rearward end 38. Providing support of the upper wall 58 at the rearward end 38 improves the structural integrity of the box portion 33 where it is most needed if the female electrical terminal 22 is not fully seated, i.e., where the secondary lock 20 would impact the box portion 33 (FIG. 4).

Figure 3A:
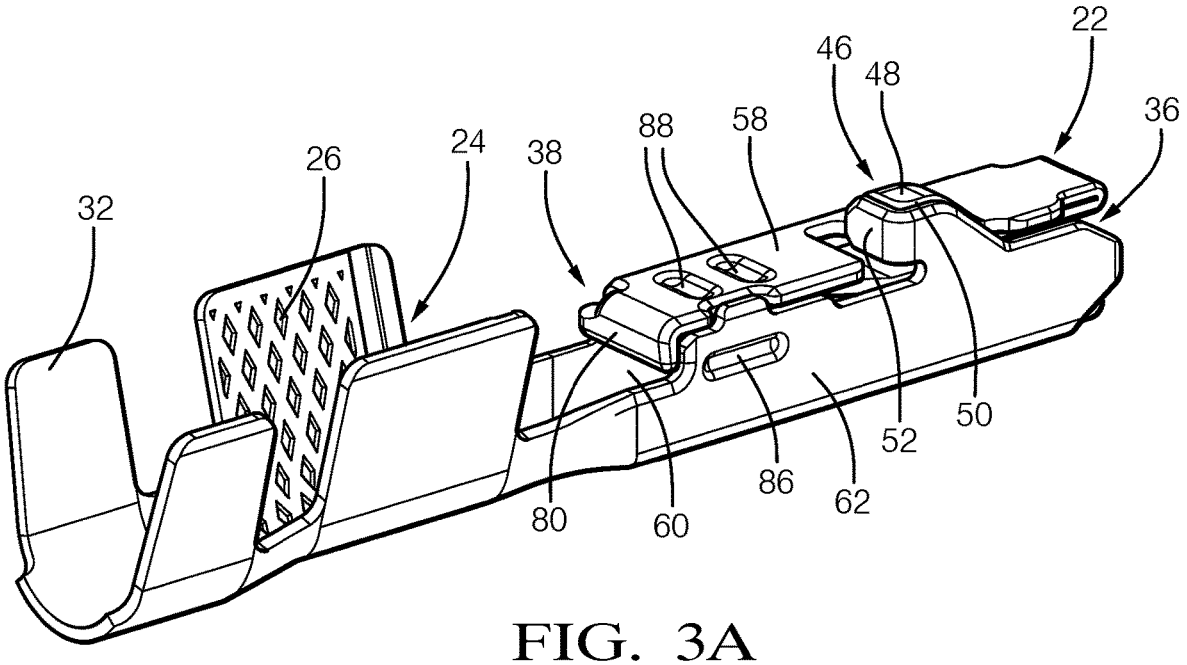
FIG. 3A is a perspective view of the example female electrical terminal.
Figure 3B:
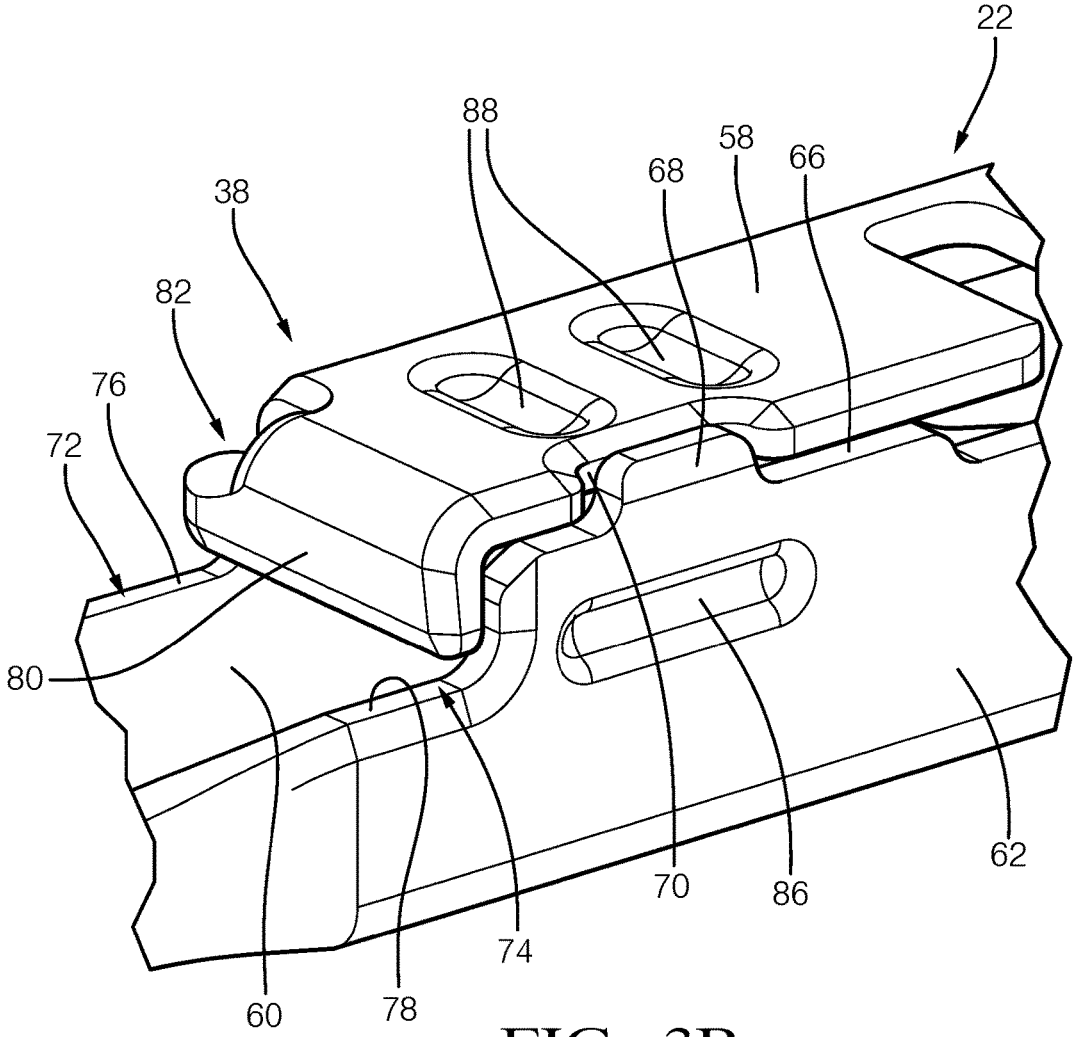
FIG. 3B is an enlarged view a rearward end of a box portion of the female electrical terminal shown in FIG. 3A.
Figure 5:
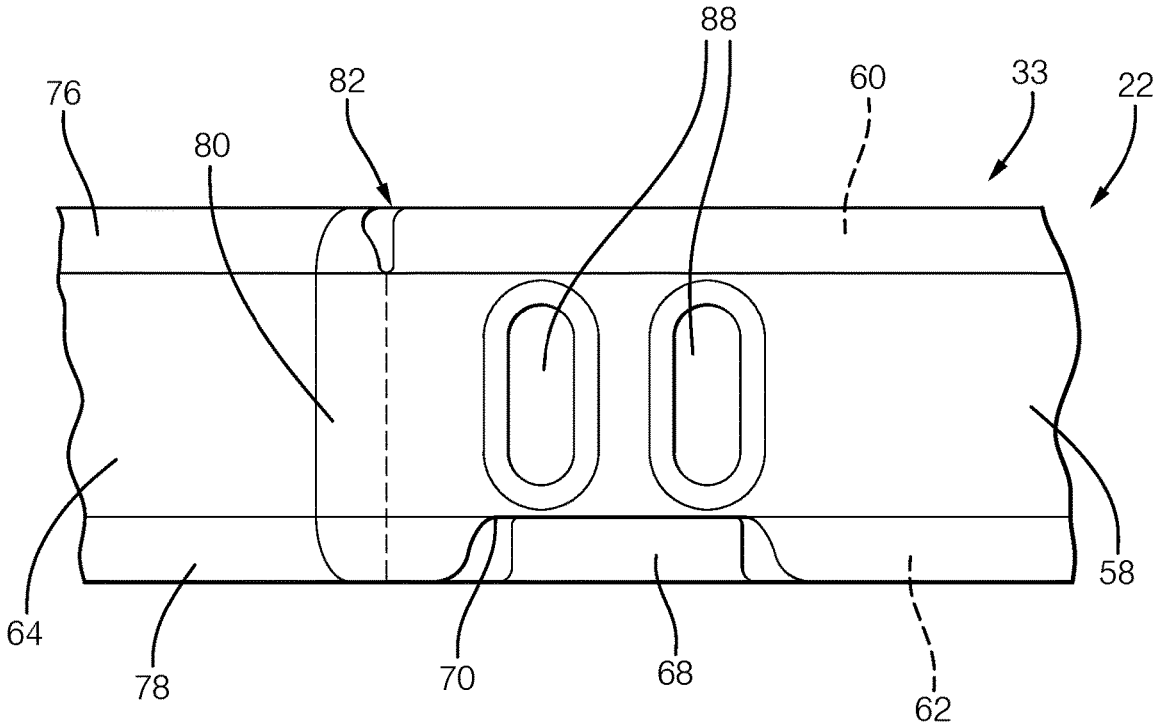
FIG. 5 is a top elevational view of the rearward end of the box portion.

Referring to FIGS. 3B and 5, the first and second lateral walls 60, 62 respectively include first and second notch portions 72, 74 that respectively provide first and second ledges 76, 78. The rearward end 38 of the box portion 33 includes a folded end portion 80 that extends downward toward the lower wall 64. The folded end portion 80 extends the lateral width of the box portion 33 to overlaps the first and second ledges 76, 78. The folded end portion 80 is spaced from the first and second ledges 76, 78 to provide a gap 84 (FIG. 2C). The folded end portion 80 includes a cutout 82 (FIG. 3B) to facilitate folding of the female terminal preform 90.

The second lateral wall 62 includes a lateral depression or indentations, hereinafter referred to as the lateral indentation 86, that is longitudinally aligned with the tab 68 is defined within the second lateral wall 62. The upper wall 58 defines one or more upper depressions or indentations hereinafter referred to as the upper indentations 88 longitudinally aligned with the cutout 70. The lateral indentation 86 and the upper indentations 88 provide reinforcement to the upper wall 58 and second lateral wall 62 in an area of the box portion 33 that is susceptible to separating and/or crushing if the secondary lock 20 is moved to a blocked position (FIG. 4) in which the secondary lock 20 impacts the box portion 33 with the female electrical terminal 22 unseated. If the secondary lock 20 applies sufficient force during assembly to deflect the box portion 33, the folded end portion 80 engages the first and second ledges 76, 78, thereby inhibiting the box portion 33 from being crushed. Limiting deformation of the box portion 33 in this manner inhibits the secondary lock 20 from being moved from the blocked position to the closed position (FIG. 2C), providing a visual indication that one or more electrical terminals are not fully seated.

Figure 6:
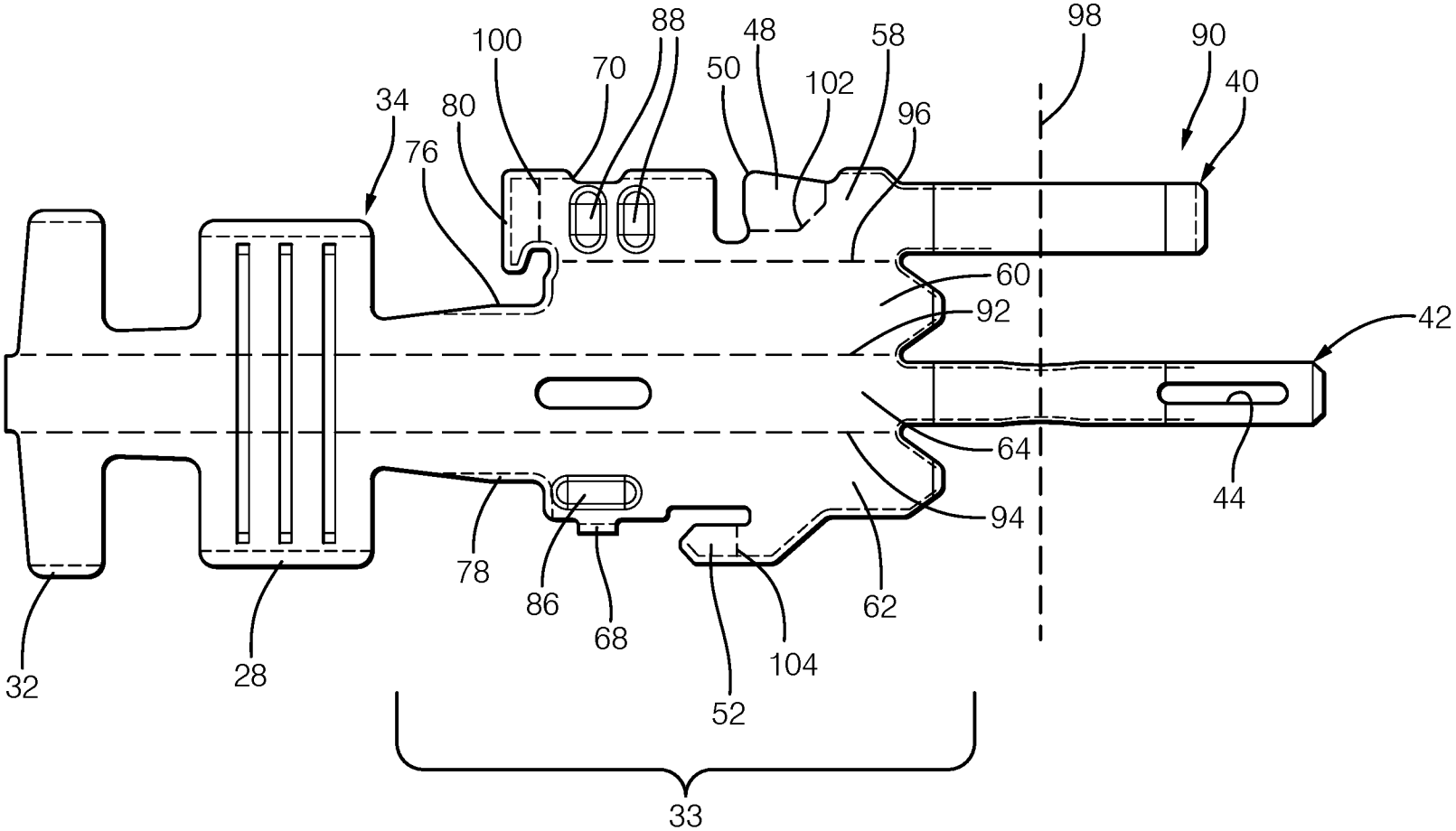
FIG. 6 illustrates the female terminal preform prior to folding into the female electrical terminal shown in FIG. 3A.
Figure 7:
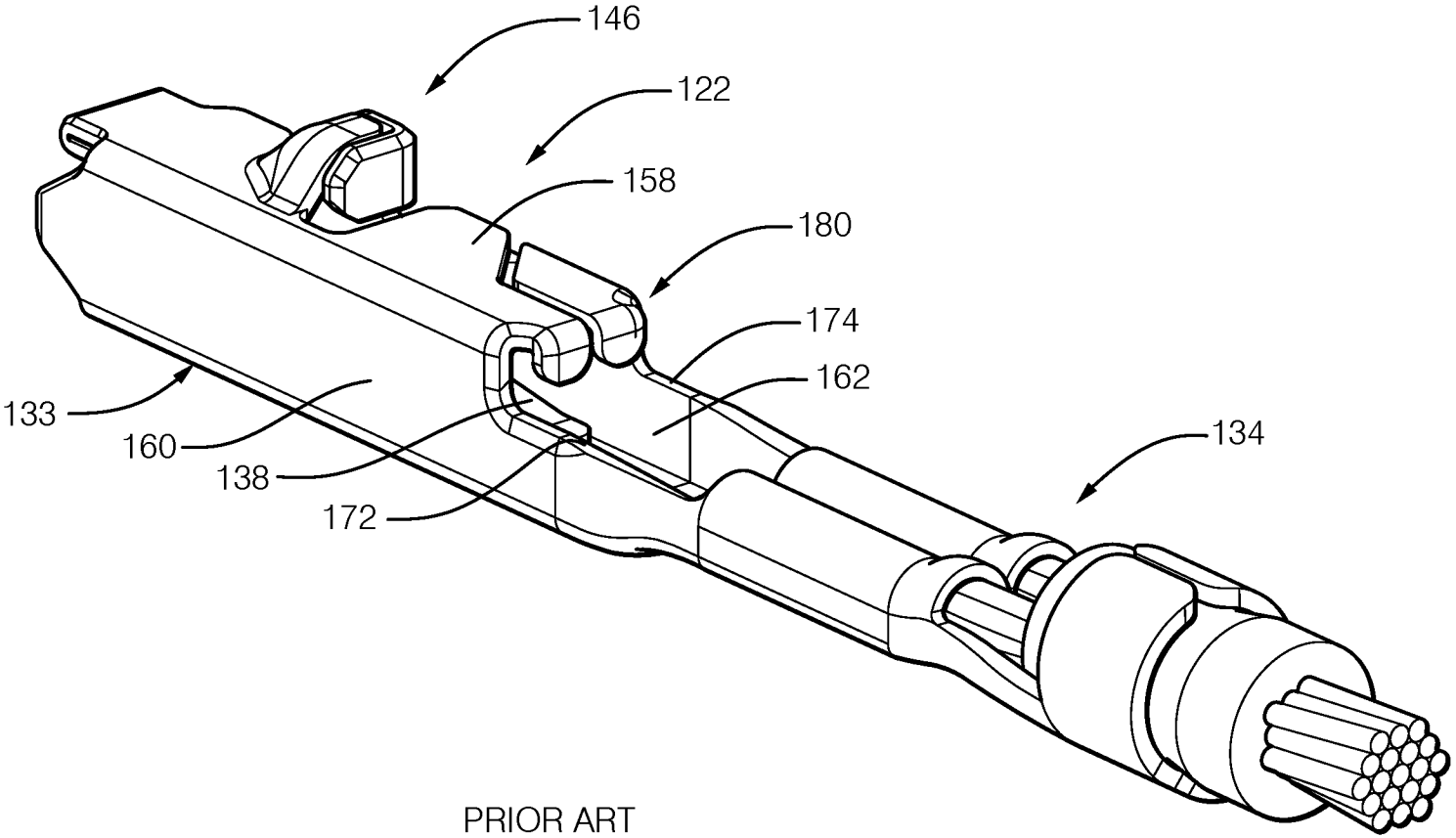
PRIOR ART FIG. 7
FIGS. 7-8D illustrate various views of a prior art female electrical terminal.
Figure 8A:
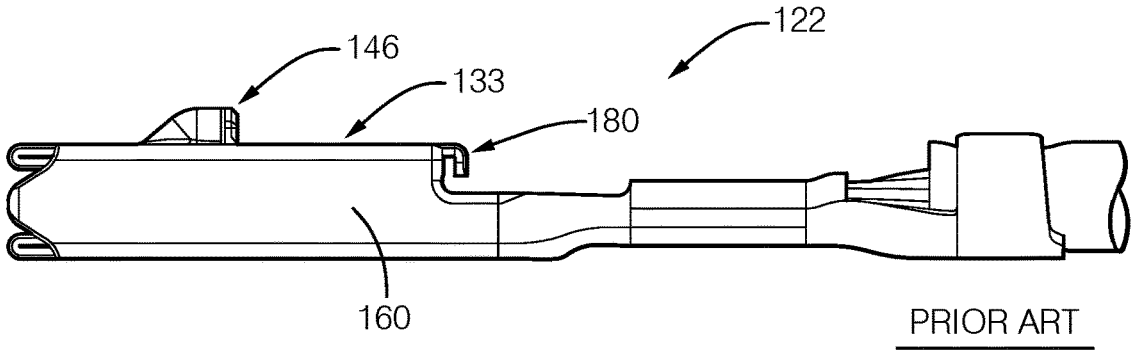
PRIOR ART FIG. 8A
Figure 8B:
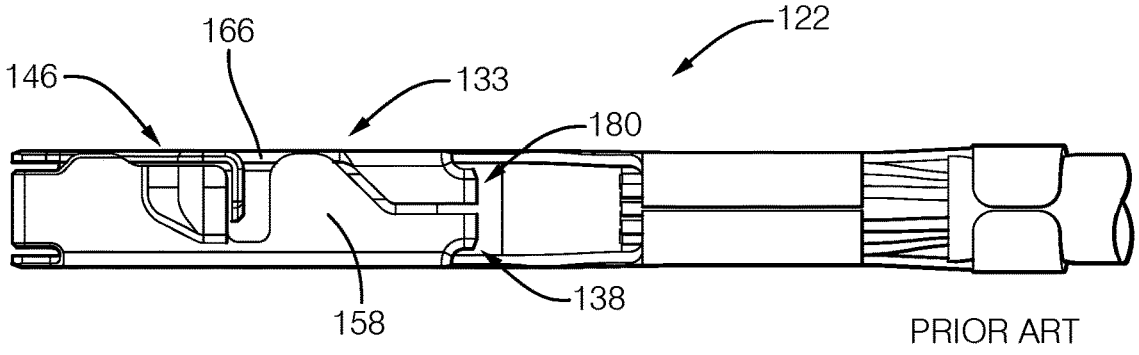
PRIOR ART FIG. 8B
Figure 8C:
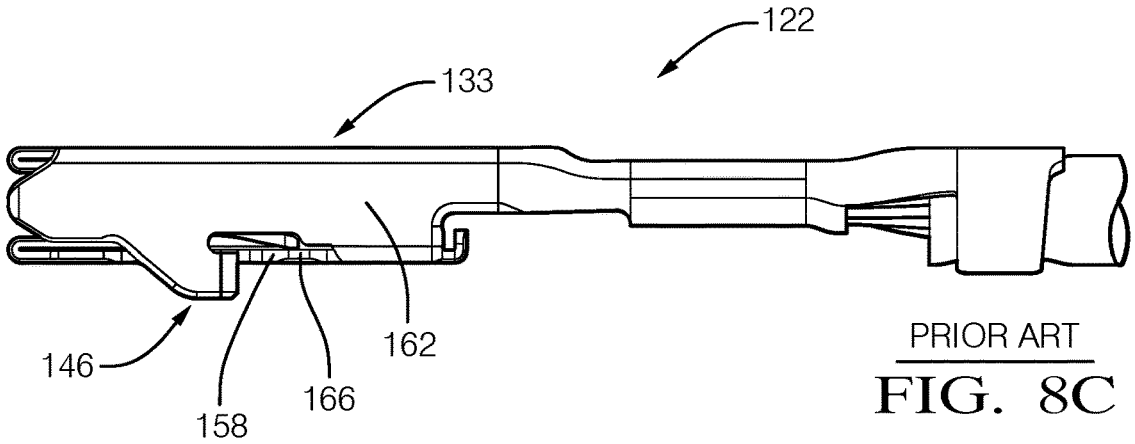
PRIOR ART FIG. 8C
Figure 8D:
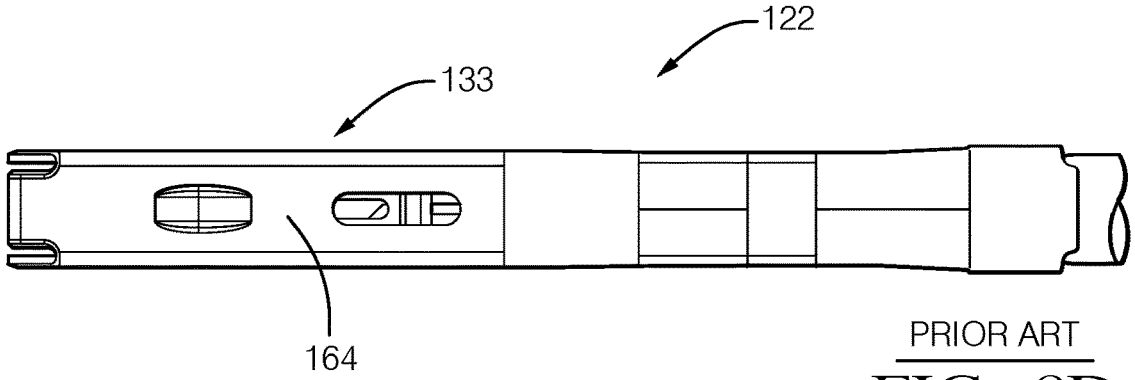
PRIOR ART FIG. 8D

Referring to FIG. 6, a metallic terminal preform 90 is used to form the female electrical terminal 22. The terminal preform 90 includes first, second and third longitudinal fold lines 92, 94, 96 which are used to form the box portion 33. A biasing tab fold line 98 provides the first and second contact tabs 40, 42, which are folded prior to forming the box portion 33. An end fold line 100 is used to provide the folded end portion 80. First and second protrusion folds 102, 104 are used to respectively form the raised portion 48 and the bent member 52.

In operation, the electrical connector 10 is assembled by inserting a female electrical terminal 22 into a longitudinal opening 12 of the electrical connector 10. The box portion 33 extends longitudinally from the crimp end 34 at a rearward end 38 to an open end 36, which is configured to receive a male electrical terminal. The box portion 33 provides upper and lower walls 58, 64 joined by a first lateral wall 60. A second lateral wall 62 is joined to the lower wall 64 opposite the first lateral wall 60. The upper wall 58 overlaps and abuts a longitudinal edge 66 of the second lateral wall 62 at the rearward end 38 of the box portion 33 opposite the open end 36.

During insertion of the female electrical terminal 22 into the longitudinal opening 12, a primary lock 54 is deflected by a protrusion 46 on the female electrical terminal 22. If the female electrical terminal 22 is fully seated into the electrical connector 10, the primary lock 54 returns to a relaxed state such that a shoulder 56 of the primary lock 54 is positioned to inhibit the protrusion 46 from sliding past the shoulder 56.

A secondary lock 20 is slid from an open position toward a locked position to retain the female electrical terminal 22 in the electrical connector 10. In a closed position, the secondary lock 20 is arranged behind the rearward end 38 of the box portion 33, which provides an additional retention mechanism for inhibiting the electrical terminal from pulling out of the electrical connector 10. However, if the female electrical terminal 22 is not fully seated within the electrical connector 10, the secondary lock 20 will engage the rearward end 38 of the box portion 33. The structural reinforcements to the rearward end 38 of the box portion 33, for example, the tab 68 and the cutout 70, the folded end portion 80, and/or the lateral indentation 86 and the upper indentations 88, inhibit the box portion 33 from being crushed. As a result, the secondary lock 20 cannot move to the closed position, which visually indicates to the electrical connector assembler that one or more terminals needs to be fully seated within the electrical connector 10.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'one or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, while terms of ordinance or orientation may be used herein these elements should not be limited by these terms. All terms of ordinance or orientation, unless stated otherwise, are used for purposes distinguishing one element from another, and do not denote any particular order, order of operations, direction or orientation unless stated otherwise.

We claim:

1. A female electrical terminal comprising:

a box portion extending longitudinally from an attachment portion to an open forward end that is configured to receive a male electrical terminal, wherein the box portion is provided by an upper wall and a lower wall joined by a first lateral wall and a second lateral wall joined to the lower wall opposite the first lateral wall, wherein a portion of the upper wall overlaps and abuts a longitudinal edge of the second lateral wall opposite at a rearward end of the box portion opposite the open forward end, wherein the upper wall defines a cutout, and the second lateral wall includes a tab received in the cutout, and wherein the second lateral wall includes a lateral indentation longitudinally aligned with the tab.

2. The female electrical terminal of claim 1, wherein the upper wall includes an upper indentation longitudinally aligned with the cutout.

3. The female electrical terminal of claim 1, wherein the first and second lateral walls respectively include first and second notches that respectively provide first and second ledges, wherein the upper wall has a folded end portion overlapping the first and second ledges.

4. The female electrical terminal of claim 1, wherein the first and second lateral walls respectively include first and second notches that respectively provide first and second ledges, and wherein the upper wall has a folded end portion overlapping the first and second ledges.

5. The female electrical terminal of claim 4, wherein the lateral indentation is arranged in the second lateral wall and longitudinally aligned with an upper indentation arranged in the upper wall and longitudinally aligned with the cutout.

6. The female electrical terminal of claim 1, wherein the upper wall has a first contact tab extending inward into the open forward end of the box portion, and the lower wall has a second contact tab extending inward into the open forward end of the box portion.

7. The female electrical terminal of claim 6, wherein at least one of the first and second contact tabs includes a slot configured to receive a nub on the male electrical terminal.

8. The female electrical terminal of claim 1, wherein the upper wall provides a protrusion provided by a raised portion on the upper wall and a bent member on the second lateral wall that is arranged about a corner of the raised portion and wherein the protrusion is configured to cooperate with an electrical connector.

9. An electrical connector comprising:

a connector body having a longitudinal opening with a width and a height, the longitudinal opening including a groove, and a primary lock is aligned with the groove;

a secondary lock slidably supported by the connector body, wherein the secondary lock is movable between an open position, a blocked position, and a closed position and wherein the blocked position is arranged between the open position and the closed position;

a female electrical terminal having a box portion extending longitudinally from an attachment portion to an open forward end that is configured to receive a male electrical terminal, wherein the box portion is provided by an upper wall and a lower wall joined by a first lateral wall and a second lateral wall joined to the lower wall opposite the first lateral wall, wherein a portion of the upper wall overlaps and abuts a longitudinal edge of the second lateral wall opposite at a rearward end of the box portion opposite the open forward end, and wherein abutment of the secondary lock with the upper wall forward of the rearward end inhibits movement of the secondary lock from the blocked position to the closed position when the female electrical terminal is in an unseated position within the electrical connector.

10. The electrical connector of claim 9, wherein the upper wall defines a cutout and wherein the second lateral wall has a tab received in the cutout.

11. The electrical connector of claim 10, wherein the first and second lateral walls respectively include first and second notches that respectively provide first and second ledges and wherein the upper wall has a folded end portion overlapping the first and second ledges.

12. The electrical connector of claim 11, wherein the box portion includes a lateral indentation arranged in the second lateral wall and longitudinally aligned with the tab or an upper indentation arranged in the upper wall and longitudinally aligned with the cutout.

13. The electrical connector of claim 10, wherein the first and second lateral walls respectively include first and second notches that respectively provide first and second ledges, wherein the upper wall has a folded end portion overlapping the first and second ledges, and wherein the folded end portion is spaced apart from the first and second ledges when the secondary lock does not abut the upper wall.

14. The electrical connector of claim 13, wherein the folded end portion engages the first and second ledges when the secondary lock abuts the upper wall when in the blocked position.

15. The electrical connector of claim 9, wherein the upper wall provides a protrusion formed by a raised portion on the upper wall and a bent member on the second lateral wall that is arranged about a corner of the raised portion, wherein the protrusion is seated against the primary lock when the female electrical terminal is in a fully seated position.

16. The electrical connector of claim 15, wherein the secondary lock is positioned between the rearward end of the box portion and the attachment portion when in the closed position.

17. The electrical connector of claim 9, wherein the upper wall defines a cutout and wherein the second lateral wall has a tab received in the cutout.

18. A method of assembling an electrical connector comprising the steps of:

inserting a female electrical terminal into an longitudinal opening of the electrical connector, wherein the female electrical terminal has a box portion extending longitudinally from an attachment portion to an open forward end that is configured to receive a male electrical terminal, wherein the box portion is provided by an upper wall and a lower wall joined by a first lateral wall and a second lateral wall joined to the lower wall opposite the first lateral wall, wherein the upper wall provides a protrusion configured to cooperate with the electrical connector, and wherein a portion of the upper wall overlaps and abuts a longitudinal edge of the second lateral wall opposite at a rearward end of the box portion opposite the open forward end;

deflecting a primary lock disposed in the longitudinal opening with the protrusion on the female electrical terminal; and sliding a secondary lock from an open position toward a locked position to retain the female electrical terminal in the electrical connector, wherein abutment of the secondary lock with the upper wall forward of the rearward end inhibits movement of the secondary lock from a blocked position, arranged between the open position and the locked position, to the locked position when the female electrical terminal is in an unseated position within the electrical connector.

19. The method of claim 18, wherein the upper wall includes a notch, wherein the second lateral wall has a tab received in the notch, wherein the first and second lateral walls respectively include first and second notches that respectively provide first and second ledges, wherein the upper wall has a folded end portion overlapping the first and second ledges, and wherein the box portion includes a lateral indentation arranged in the second lateral wall and longitudinally aligned with the tab or an upper indentation arranged in the upper wall and longitudinally aligned with the notch.

* * * * *